US007299780B1

(12) United States Patent
Thompson

(10) Patent No.: US 7,299,780 B1
(45) Date of Patent: Nov. 27, 2007

(54) DUAL HIGH-PRESSURE LUBE-OIL PUMPS FOR DIESEL FUEL INJECTION

(76) Inventor: Brian M. Thompson, P.O. Box 246, Lead Hill, AR (US) 72644

( * ) Notice: Subject to any disclaimer, the term of this patent is extended or adjusted under 35 U.S.C. 154(b) by 161 days.

(21) Appl. No.: 11/146,292

(22) Filed: Jun. 6, 2005

Related U.S. Application Data

(60) Provisional application No. 60/577,308, filed on Jun. 5, 2004.

(51) Int. Cl.
*F01M 11/02* (2006.01)
*F01M 11/00* (2006.01)

(52) U.S. Cl. ..... 123/196 R; 184/6.28

(58) Field of Classification Search ..... 123/44, 123/502, 198 C, 196 R; 184/27.2, 104.2, 184/6.28; 418/15, 39
See application file for complete search history.

(56) References Cited

U.S. PATENT DOCUMENTS 4,305,352 A * 12/1981 Oshima et al. ..... 123/90.15
4,334,836 A * 6/1982 Kubis et al. ..... 417/364
5,485,820 A * 1/1996 Iwaszkiewicz ..... 123/458
5,771,854 A * 6/1998 Barton ..... 123/196 R
5,787,854 A * 8/1998 Uhlig et al. ..... 123/196 R
5,816,212 A * 10/1998 Lindquist et al. ..... 123/196 R
5,839,412 A * 11/1998 Stockner et al. ..... 123/446
5,896,841 A * 4/1999 Nemoto et al. ..... 123/381

OTHER PUBLICATIONS

International® T 444E Diesel Engine Service Manual (Navistar International Transportation Corp. Jan. 1994) Introductory Section (engine description). pp. 18-31. and Section 11 (high pressure lube oil system). pp. 1-12.

* cited by examiner

*Primary Examiner*—Mahmoud Gimie
(74) *Attorney, Agent, or Firm*—Jonathan A. Bay

(57) ABSTRACT

A lube-oil pump system for a diesel engine's fuel injection system has a first and second pump. Each pump is a multi-plunger swash-plate type pump. The first pump mounts to a neck portion of a front cover of the engine's crankcase and has a driven gear that meshes with and is driven by gear teeth formed on the engine's camshaft. The second pump mounts vertically stacked on top of the first pump and has its own driven gear that meshes with and is driven by the gear of the first pump. The second pump is configured to operate in the counter-rotational direction as the first pump.

13 Claims, 5 Drawing Sheets

DUAL HIGH-PRESSURE LUBE-OIL PUMPS FOR DIESEL FUEL INJECTION

CROSS-REFERENCE TO PROVISIONAL APPLICATION(S)

This application claims the benefit of U.S. Provisional Application No. 60/577,308, filed Jun. 5, 2004, which disclosure is incorporated by this reference thereto.

BACKGROUND AND SUMMARY OF THE INVENTION

The invention relates to fuel injection for diesel engines and, more particularly, to the high-pressure lube-oil supply system therefor.

FIGS. 1 and 2 show a conventional fuel injection system 20 for a diesel engine and high-pressure lube-oil supply system 30 as well, all in accordance with the prior art. For sake of an example, FIG. 1 is a schematic based upon a model T444E diesel engine of the Navistar International Transportation Corporation (circa 1994).

In general, the fuel system 20 has a pump 22 drawing fuel from a tank 24 and pumping it through a filter 26. Fuel pumped from this stage is divided through steel lines that lead into the back of each cylinder head. Each of these lines supplies a stream of fuel to a respective gallery drilled in each respective head, wherein these galleries intersect each injector bore to the cylinders. The fuel system 20 utilizes hydraulically-actuated injectors 28 to inject fuel into each cylinder. The hydraulic fluid utilized for this service is the engine's lube oil. Accordingly, to handle such a service, there is naturally some fashion of a pressurized lube-oil system (i.e., indicated as 30). Indeed, it is more conventionally referred to as a high-pressure lube-oil system 30 or the like.

The high-pressure lube-oil system 30 is able to produce operating pressures in a range between about 500 and 3000 psi (3,500 and 20,000 kPa) for service of hydraulic actuation of the fuel injectors 28. The fuel injectors 28, although driven by the actuation pressures noted just previously, are arranged to amplify/boost the delivered drive-pressures of the lube-oil such that the injected fuel (e.g., injected into the combustion chambers, but ejected from the injectors 28) is pressurized all the way up to about 18,000 psi (125,000 kPa).

As FIG. 1 shows better, the high-pressure lube-oil system 30 draws lube oil from the oil pan 31 through a pickup tube by an engine oil (i.e., lube oil) pump. The engine oil pump can be a gerotor type pump mounted-axially on the front end of the crankshaft, which drives it. Lube oil is pumped through an oil cooler 33, then oil filter 35, and conducted through passages in the crankcase's front cover to the high-pressure lube-oil system 30's reservoir that is mounted on top of the crankcase's front cover (the reservoir is not depicted in this drawing, but is indicated as 44 in FIG. 2).

The reservoir 44 makes available a constant supply of lube oil to a high-pressure lube-oil pump 32, which is mounted to a neck portion of the crankcase's front cover, and from there extends back into the engine block's "V." Preferably the high-pressure lube-oil pump 32 is a nine (9) plunger swash-plate pump that has a drive gear that is driven by a camshaft gear. High pressure lube oil is divided between a left and right supply line for the LH (left cylinder head) and RH (right cylinder head) oil-galleries. Each oil gallery supplies the high pressure lube oil to a series of branching oil rails. The oil galleries and oil rails are all machined into the cylinder heads.

In operation, when an injector 28 is energized, a poppet valve thereof is opened by an attached solenoid valve (these are not shown). Pressurized lube oil is allowed to flow into the injector 28 and drive against an amplifier piston (not shown). When injection is ended, the lube oil pressure which was just previously applied to the amplifier piston is successively then vented by the poppet valve, and onward through oil spouts mounted on the top of the injector 28, which not only releases the pressure applied to the amplifier piston but also returns the spouting lube oil to the sump 31.

Control over the lube oil's service pressure is obtained by means of, in combination, data signals provided by an injection control pressure (ICP) sensor (not shown), and injector drive module (IDM) 37, control instructions sent by electronic control module (ECM) 39, which are acted upon by an injection pressure regulator (IPR) valve 34. By way of background, the high-pressure lube-oil pump 32 is designed to deliver output at simply one design pressure. Regulated control over the lube oil's service pressure is henceforth obtained by the injection pressure regulator (IPR) valve 34, which is mounted in a cavity for it in the body of the high-pressure lube-oil pump 32. The IPR 34 regulates service pressure by dumping excess lube oil through a check valve into the crankcase's front cover, eventually to drain back down to the sump 31.

There are various shortcomings with the prior art high-pressure lube-oil system 30. As a matter of background, if a mechanic wishes to optimize a diesel engine for performance, one choice involves exchanging the original factory-equipment injectors for larger, custom or high-performance injectors.

Alternatively or in addition, the controller 39's control over the injectors 28 might be changed to dwell longer. Either way, bigger injectors or longer dwell means a greater rate of fuel consumption. But the problem is this. That is, there isn't a sufficient supply of high-pressure lube oil to keep pace with such greater rate of fuel consumption. Typically, the original-equipment high-pressure lube-oil pump 32 is simply under-capacity to meet the increased capacity needs.

What is needed is a solution which overcomes the shortcomings of the prior art.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 2:
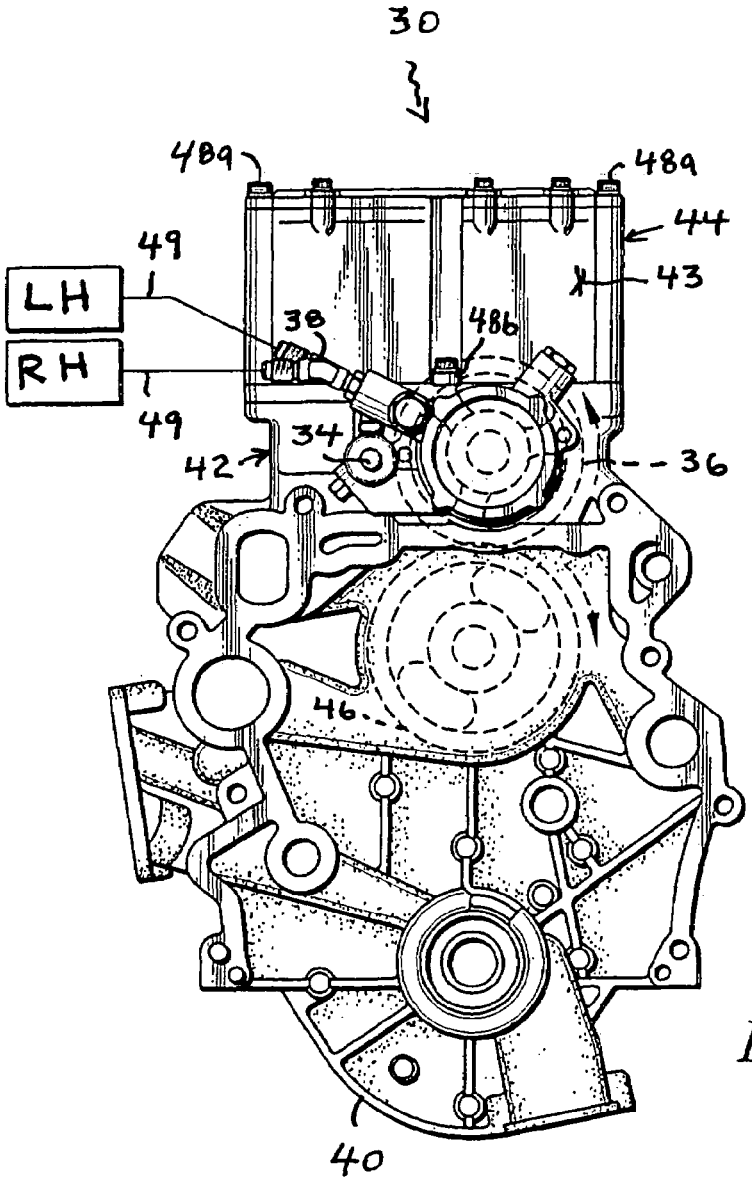
FIG. 2. (PRIOR ART)
FIG. 2 is a rear elevational view of a crankcase's front cover for a diesel engine and depicting other aspects of a representative, high-pressure lube-oil system in accordance with the prior art.
Figure 3:
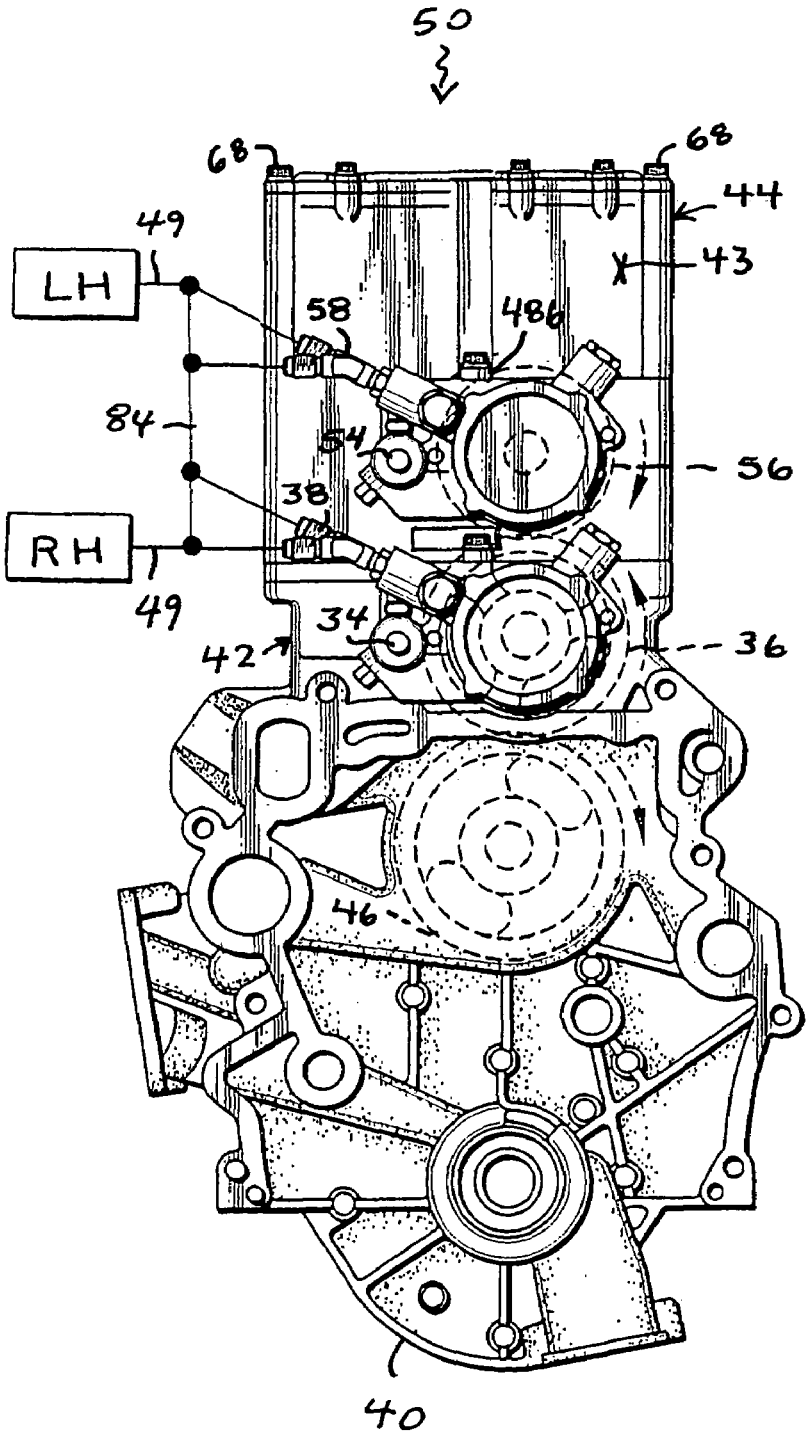
FIG. 3 is a rear elevational view comparable to FIG. 2 except depicting aspects of a high-pressure lube-oil system in accordance with the invention.

FIG. 3 shows a dual-pump, high-pressure lube-oil system 50 in accordance with the invention. It combines an original-equipment high-pressure lube-oil pump 32 with an inventively-deployed supplementary pump 52. FIG. 2 contrastingly shows merely a representative single-pump system 30 in accordance with the prior art. FIGS. 2 and 3 allow comparative study between each other for readily highlighting the distinctions between the invention and prior art.

It is an aspect of the invention that just even the possibility of inventively-deploying the supplementary pump (in the way that is here) is advantageously facilitated by an inventive housing block 60. The housing block 60 will be more particularly described below, in part as developed through a series of three views of it in isolation (i.e., FIGS. 4 through 6).

Figure 4:
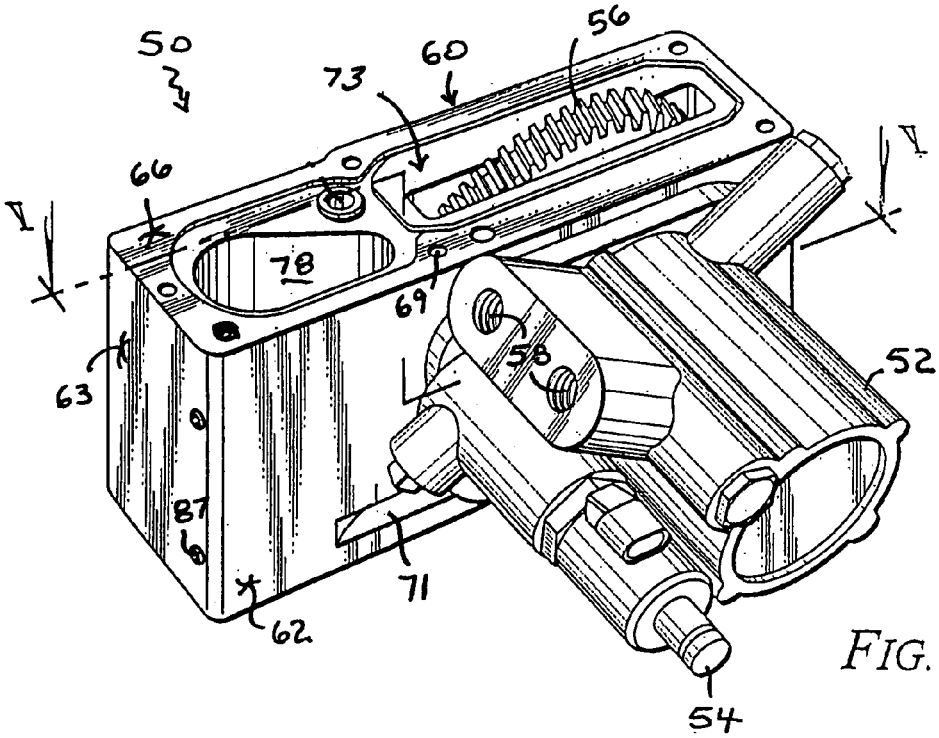
FIG. 4 is an enlarged scale perspective view of the upper or supplemental high-pressure lube-oil pump and housing block therefor in accordance with the invention.

Referring back to FIG. 2, it affords the opportunity to more particularly describe the state of the prior art. The crankcase's front cover 40 extends upwardly to culminate in a neck-portion 42 that terminates in a machined flange surface (not shown, but a substantial replication of it is shown by FIG. 4). The flange surface serves in part to allow a gasket-sealed joint to be formed with a lidded reservoir 44, which has a counterpart flange-surface bottom (not shown). The reservoir 44 is bolted to neck portion 42 of the front cover 40 by five bolt-connections 48*a/b* (or, i.e., five in this example) arranged in an array of two bolt-connections along each of the two longer sidewalls (i.e., the one plainly in view in FIG. 2 is a rear sidewall 43) and one more 48*a* in the middle of the right sidewall. The front sidewall (not in view) and right sidewall (not in view) have their three bolted-connections formed by three elongated mounting bolts 48*a* extending through bore holes therefor that penetrate all the way down through the material of the of the reservoir 44 (i.e., spanning the full measure of the height of the reservoir 44) in order to allow the bolts 48*a* to poke out beyond the flange bottom of the reservoir 44 and thereafter screw into threaded holes for them formed in the neck portion 42 of the front cover 40 (i.e., and as apertured through the flange surface thereof). The rear sidewall 43 has its left, outer bolted-connection 48*a* formed the same way.

However, the rear sidewall 43 has another bolted-connection 48*b*, more in the middle, that is formed differently. For this different bolted-connection, the neck portion 42 is formed to secure a threaded stud which extends up above the plane of the flange surface by just a small measure. The reservoir 44's rear side wall 43 is formed with an apertured foot-pad along 48*b* its bottom, for allowing insertion and extension therethrough of the threaded stud of the neck portion 42 when the reservoir 44 is seated on the neck portion 42. Tightening the four mounting bolts 48*a* and a nut on the threaded stud sticking through the apertured foot-pad 48*b* sufficiently mounts the reservoir 44 to the neck portion 42.

The source of drive for the high-pressure lube-oil pump 32 can be reckoned as supplied by the camshaft and as, more particularly, taken off the camshaft's front gear 46. The front cover 40's neck portion 42 is formed with suitable cavities and apertures (none shown, but fair replications thereof are shown FIGS. 4-6) to allow for the rotational operation of a pump-drive gear 36. Both these gears 36 and 46 are helical gears, of opposite tooth-pitch angle (this is not shown, but see FIG. 4, wherein the tooth-pitch angle shown there corresponds to that of the camshaft gear 46).

Figure 5:
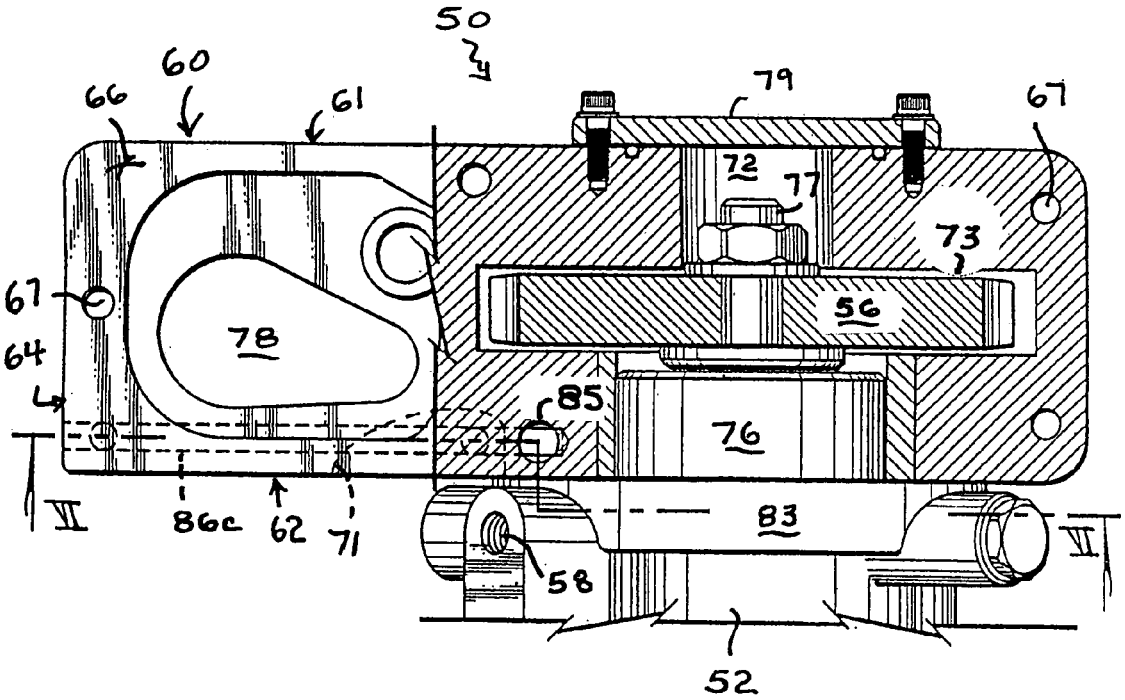
FIG. 5 is a partial section view taken along offset line V-V in FIG. 4.

The neck portion 42 of the crankcase's front cover 40 has a rear sidewall, as shown by FIG. 2. The rear side wall is (none of the following is shown until as noted below) bored all the way through to the front sidewall at least by a minor diameter. It is bored only about a third of the way through by a major diameter. A central region between the front and rear sidewalls is formed with an enlarged vertical slot that allows clearance for the pump-drive gear. The major diameter portion of the bore allows for a close-fitting insertion of the pump unit's cylindrical bearing block. The cylindrical bearing block has a relatively-short drive shaft extending out from it for insertion through and coupling with a center hole in the pump-drive gear. The drive shaft has a terminal end formed with external thread for accepting a tightening nut. The minor diameter through the neck portion is sized not only for rotational clearance of the nut but also for access by a socket wrench. The opening of the minor diameter through the front sidewall is covered by an O-ring sealed plate. Now, even though none of the foregoing is actually shown in the drawings, a fair replication of it all is shown by FIG. 5.

The neck portion 42 of the front cover 40 has a columnar or standpipe conduit formed in it (as before, not much of the following is shown until as noted below) which, during engine operation, is pumped full of lube oil by the engine oil (e.g., lube oil) pump described in connection with FIG. 1 (i.e., the one typically mounted axially on the front end of the crankshaft, not camshaft, and which, e.g., is fairly typically of a gerotor type pump). Excess lube oil rising up the column of the standpipe conduit is conducted into the reservoir 44 for reserve storage. Excess overflow of lube oil in the reservoir 44 is allowed to spill out a vent or over a ledge but in any case, preferably directed to be discharged on top of the pump-drive and camshaft gears 36 and 46 in order to provide lubrication thereto. Now, even though not much of the foregoing is actually shown in the drawings, a fair replication of at least the standpipe passageway is shown by FIGS. 4 and 5.

In use, the pump unit 32 suctions in lube oil in from the standpipe conduit and discharges a pressurized flow of lube oil out a pair of dual discharge ports 38. The discharge ports 38 are connected by flowlines 49 to supply the left cylinder head (LH) and right cylinder head (RH) as described above in the background section. It is presumed without it having been independently measured or verified that, the delivery outflows are substantially the same in both lines 49 (i.e., as in pressure and flowrate).

Now to turn more particularly to FIG. 3. There is an inventive advantage to be obtained as described above in the background section if the high-pressure lube-oil supply can be boosted somehow above the prior capacity of the state of the prior-art original equipment. FIGS. 3 through 6 develop once such way of accomplishing such an inventive advantage.

FIG. 3 introduces the dual-pump, high-pressure lube-oil system 50 in accordance with the invention, in which the original-equipment high-pressure lube-oil pump 32 is combined with an inventively-deployed supplementary pump 52. In general, the inventive supplementary pump 52 is inserted—sandwich-meat style—at the plane of the gasket-sealed joint between the front cover 40's neck portion 42's top flange and the original-equipment reservoir 44. Various objects of the invention include the exercise of a high degree of effort (i) to retain all the original-equipment high-pressure lube-oil system 30's equipment, (ii) as well as doing so without modifications to any of it either, and, aside from the reservoir 44, (iii) to keep things in their original place, substantially unmoved.

Accordingly, FIG. 3 shows that the original-equipment pump unit 32 is not simply just retained but kept in its original position, unmoved, and unmodified. The original-equipment reservoir 44 is, however, re-installed at an elevated position (relative its original-equipment elevation) by virtue of being installed on and attached to the inventive housing block 60.

Figure 6:
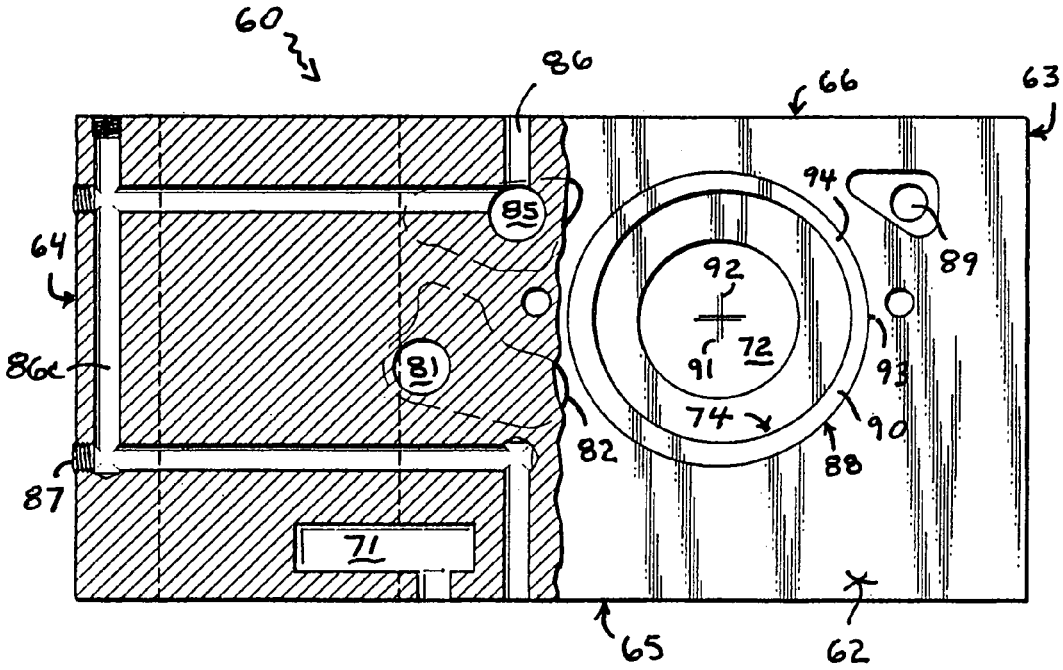
FIG. 6 is a partial section view taken along offset line VI-VI in FIG. 5, with the supplementary pump unit removed from view.

The inventive housing block 60 is shown better by FIGS. 4 through 6. It has a six-sided block shape, including front and rear sidewalls 61 and 62 spaced by spaced left and right sidewalls 63 and 64, the four of which together extend between top and bottom flange surfaces 66 and 65, respectively. The housing block 60's bottom flange surface 65 is designed as a substantial duplication of the shape and arrangement of the original-equipment reservoir 44's bottom flange surface (neither shown). That way, the housing block can be mated onto the front cover 40's neck portion 42 just the same as the original-equipment reservoir 44 (e.g., including as by a gasket-sealed joint), without any modification to the front cover 40's neck portion 42.

Likewise, the housing block 60's top flange 66 surface is designed as a substantial duplication of the shape and arrangement of the top flange surface of the front cover 40's neck portion 42. That way, the housing block 60 can accept the mating to it of the original-equipment reservoir 44 just the same as the top flange surface of the front cover 40's neck portion 42 (and, e.g., as including a gasket-sealed joint), and likewise again without any modification to the original-equipment reservoir 44.

To achieve this object in part, the housing block 60 includes four bore holes 67 that extend all the way through the housing block 60 for sliding passage of four mounting bolts 68. Unlike the original-equipment mounting bolts 48*a* (the heads of which at least are shown in FIG. 2), the inventive dual-pump system 50 as shown by FIG. 3 will require replacement mounting bolts (e.g., as 68), ones which are about 4¾ inches (~12 cm) longer (or, e.g., by about the measure of the chosen height for the housing block 60). Accordingly, the inventive dual-pump system 50 is removably installed by four elongated mounting bolts 68 that are arranged in the same pattern as for the original-equipment single-pump system 30.

However, the original-equipment single-pump system's fifth-bolt connection—the one achieved by a threaded stud and nut tightened on an apertured footpad 48*b* provided by the original-equipment reservoir 44—has to be matched by the inventive housing block by two features, not one. First, FIG. 4 shows a stud-hole 69 bored shallowly into the top flange surface 66 for securing a threaded stud therein (not shown) and in a corresponding position of the threaded-stud projecting above the top flange surface of the front cover 40's neck portion 42. That way, the apertured foot-pad 48*b* along the bottom of the original-equipment reservoir 44's rear side wall is readily accommodated by the threaded stud sticking up from the housing block 60.

Second, FIGS. 4 and 6 show (although partly obscured) that the housing block 60 has a recess 71 formed in its rear sidewall 62 and along the bottom. The recess 71 in part is formed with an apertured foot-pad to substantially correspond to the same (e.g., 48*b*) in the original-equipment reservoir 44. That way, the threaded stud of the front cover 40's neck portion 42 is provided an aperture to insert and extend through when the housing block is seated on the neck portion. The rear sidewall 62's recess 71 is sized and arranged in other part for rotational clearance of not only a nut but also for access by a box wrench or the like (not shown).

During installation, the inventive housing block 60 is preferably seated on the neck portion 42's top flange surface of the unmodified front cover 40. Of course, this step of "seating" furthermore includes (among other things still) preparations for and inclusion of a gasket. Then, the original-equipment reservoir 44 is preferably seated on the inventive housing block 60's top flange surface 66 (including, among other things still, preparations for and inclusion of another gasket). Tightening the four mounting bolts 68 and a nut on the neck portion's threaded stud (e.g., as accessed through the recess 71) sufficiently mounts the inventive housing block 70 to the neck portion 42. Finally, tightening a nut on the inventive housing block 70's threaded stud (e.g., as extending through the apertured footpad 48*b*) sufficiently completes the mounting of the original-equipment reservoir 44 on the inventive housing block 70.

As true for the single-pump system 30 of FIG. 2, the source of drive for the inventive dual-pump system 50 can be reckoned as supplied by the camshaft and as, to be more specific, taken off the camshaft's front gear 46. FIG. 3 shows that original-equipment pump-drive gear 36 is retained in place and without modification. As can be reckoned from either FIG. 2 or 3, the original-equipment pump-drive gear 36 is situated in a common lateral plane with and generally-above the camshaft gear 46, wherein the two are enmeshed in direct, coupled contact therebetween.

FIG. 3 shows that the supplementary pump-unit 52 is likewise outfitted with a pump-drive gear 56. As noted previously, the original-equipment pump-drive gear 36 is, customarily, a helical gear. In order to mesh with that, the inventive pump-drive gear 56 presents gear teeth of the same tooth pitch angle but of the opposite left-handedness or right-handedness to that of the original-equipment pump-drive gear 36. FIG. 4 depicts a preferred embodiment of the pump-drive gear 56 in accordance with the invention.

Other factors concerning the inventive pump-drive gear 56 is that it may be designed to have virtually the same diameter as that of the original-equipment pump-drive gear 36. That way, the dual pump-units 32 and 52 will spin at virtually the same speed. However, in this preferred embodiment of the invention, the preferred intention is to obtain comparable pressures and output capacities between the two pump units 32 and 52. It is a fortuitous circumstance that a given pump-unit such as 52 can be utilized which is fairly operationally comparable to the original-equipment pump unit 32 except operates counter-rotationally to the direction of rotation of the original-equipment pump unit 32. Routine, alternative other design choices over matters of gearing ratios and pump capacities will readily be recognized by an ordinarily skilled designer as variables which can be readily varied in order to get performance as desired.

FIGS. 4 through 6 variously show that housing block 60's rear sidewall 62 is bored all the way through to the front sidewall 61 by a bore having at least a minor diameter, in consequence there being a minor diameter portion 72 of the bore intersecting the front sidewall 61. The rear sidewall 62 is bored only about a third of the way through by a portion 74 having a major diameter. A central region 73 between the front and rear sidewalls 61 and 62 is formed with an enlarged, open-ended rectangular column that allows clearance for the inventive pump-drive gear 56. The major diameter portion 74 of the bore allows for a close-fitting insertion of the inventive pump unit 52's cylindrical bearing block 76. The cylindrical bearing block 76 has a relatively-short drive shaft 77 extending out from it for insertion through and coupling with a center hole in the inventive pump-drive gear 56. The drive shaft 77 has a terminal end formed with external thread for accepting a tightening nut. The minor diameter portion 72 through the inventive housing block portion is sized not only for rotational clearance of the nut but also for access by a socket wrench (not shown). The opening of the minor diameter portion 72 through the housing block 60's front sidewall 61 is covered by an O-ring sealed plate 79.

The inventive housing block 60 has a standpipe passageway 78 formed in it which, during engine operation, is pumped full of lube oil by the engine oil (e.g., lube oil) pump described in connection with FIG. 1. Indeed, the housing block 60's standpipe passageway is shaped and arranged simply to form a smooth continuation of its counterpart formed in the front cover 40's neck portion 42. Excess lube oil rising up the column of the standpipe passageway(s) (e.g., 78 in part) is conducted into the original-equipment reservoir 44 for reserve storage. Excess overflow of lube oil in the original-equipment reservoir 44 is allowed to spill out or over the same vent or ledge described previously in connection with FIG. 1, but in any case, the spill is preferably directed to be cascade down over all three of the stack of the two pump-drive gears 56/36 and the camshaft gear 46 in order to provide lubrication thereto.

Indeed, even after engine operation is ended, the collective system of the standpipe passageways (e.g., 78 in part) and the reserve storage in the original-equipment reservoir 44 will remain filled with lube-oil, at least to the level concurrent with the timing of shutting the engine off. That is, the lube oil filled in these passageways (e.g., 78 in part) and the reservoir 44 is checked from below from draining out. That way, there is lube oil immediately on-hand for on-demand intake by the pump units 32 and 52 from the instance of restarting the engine.

It is preferred if the service of the supplementary pump unit 52 is fulfilled by a multiple (e.g., nine or 9) plunger swash-plate type high-pressure lube-oil pump. In other words, by something fairly comparable to the original-equipment pump unit 32 (except, as noted before, operative in the counter-rotational direction, and as indicated in FIG. 3). As can be partly reckoned by FIG. 6, the inventive housing block 60 has an outflow passage 81 that opens out through an opening 82 in the rear sidewall 62. At its other end, the outflow passage 81 has an origin in the standpipe passageway 78's lateral wall. The supplementary pump unit 52 has a mounting flange 83 for making a sealed joint with the mounting block 60's rear sidewall 62. The mounting flange 83 has an intake opening (not shown) for communicating with and suctioning in an intake supply of lube oil. Accordingly, the housing block 60's outflow opening 82 is located and arranged to align with the supplementary pump unit 52's intake opening in order to achieve this object.

The supplementary pump unit 52 has dual discharge ports 58, comparably as does the original-equipment pump unit 32. As FIG. 3 shows, it is an aspect of the invention that both discharge ports 58 of the supplementary pump unit 52 as well as both discharge ports 38 of the original-equipment pump 32 discharge into a common "balancing" line 84. The balancing line 84 blends the total output of both pump units 32 and 52 in order to balance or level-out pressure and flowrate differences from the two pump units 32 and 52 despite that the pump units 32 and 52 are preferably fairly closely matched to provide fairly similar performance. In any event, the balancing line 84 smooths out any differences, if any. The balancing line 84 is then connected with the high-pressure lube-oil supply lines 49 which extend off separately to left cylinder head (LH) and right cylinder head (RH).

As can also be partly reckoned by FIG. 6, the inventive housing block 60 has an IPR dump passage 85 (e.g., the IPR is the "injection pressure regulator" valve 54) that originates in an opening in the rear sidewall 62. At its other end, the IPR dump passage 85 terminates in an intersection with an IPR dump flowline 86. The flow direction of lube oil dumped by or bled-off from the supplementary pump 52 unit within the IPR dump flowline 86 is ultimately conducted up to the original-equipment reservoir 44. That is, lube oil dumped by the IPR 54 is sent back to re-join the lube oil in the collective reserve of the original-equipment reservoir 44 as well as the combined standpipe passageways (e.g., 78 in part) of inventive housing block 60 and front cover 40's neck portion 42. Again, the combined function of both the IPR 34 on the original-equipment pump unit 32 and then the comparable IPR 54 on the supplementary pump unit 52 is to provide control over the service pressure and/or flowrate of pressurized lube oil that is fed to the fuel injection system 20's injectors 28.

Figure 1:
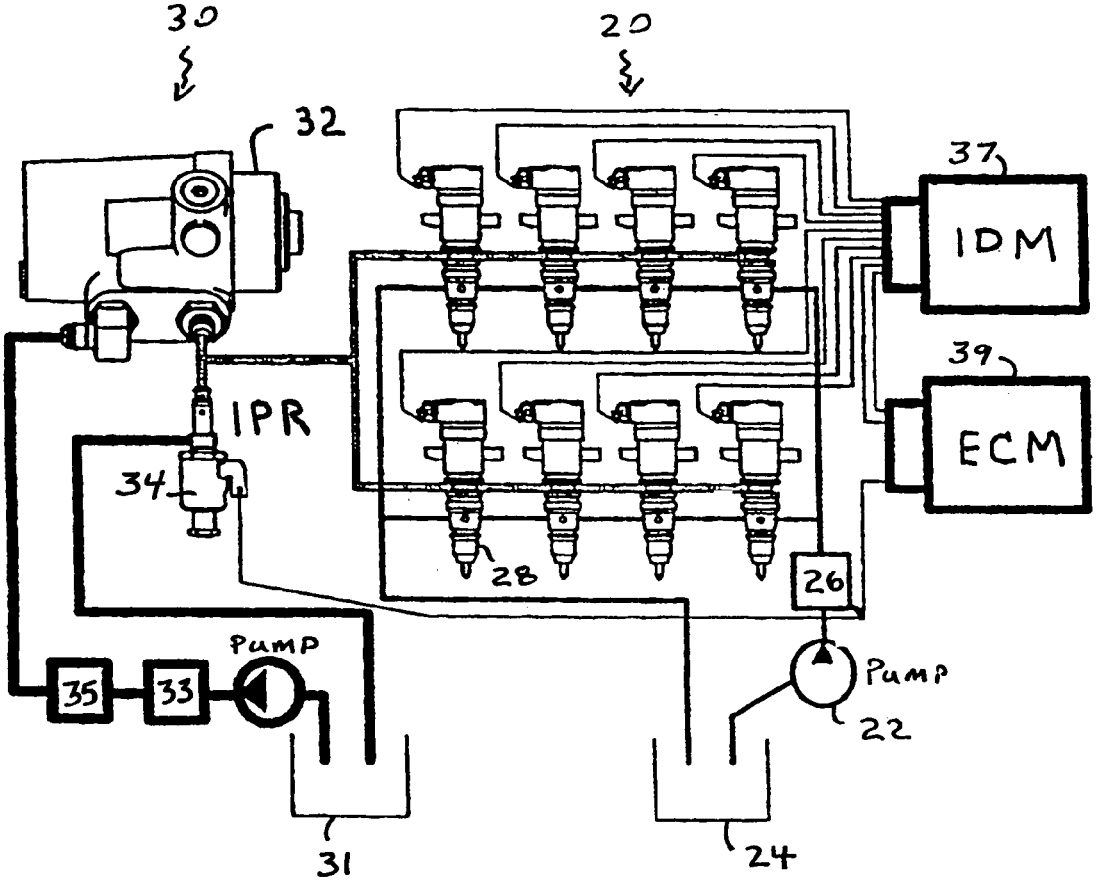
FIG. 1. (PRIOR ART)
FIG. 1 is a schematic diagram of both a fuel supply system as well as a companion high-pressure lube-oil system for a diesel engine, and both in accordance with the prior art.

As remarked upon in the background section, control over the original-equipment IPR 34 is handled by the ECM 39 (e.g., the "electronic control module" as indicated in FIG. 1). It is an aspect of the invention to control the dual IPR valves 34 and 54 simultaneously by the one original-equipment ECM 39 without modification thereto. It has been inventively discovered that this can be expediently achieved by wiring the control-signal wire to the dual IPR valves 34 and 54 such that the dual IPR valves 34 and 54 are wired up not in parallel but, in contrast, in series.

FIG. 6 shows that the main IPR dump flowline 86 has a C-shaped continuation 86*c* downstream from the IPR dump passage 85's intersection with it. The C-shaped continuation 86*c* is provided for the purpose of providing a flow passage for the IPR dump flow that is discharged by the original-equipment IPR 34 (not shown in FIG. 6 but see, e.g., FIG. 3). The C-shaped continuation 86*c* is fabricated in the inventive housing block 60 by four bore holes as shown in FIG. 6. At least three openings of the C-shaped continuation 86*c* that are a necessary result of the chosen fabrication strategy are sealed off by hex-socketed cap screws 87. Even if the C-shape is a designer's choice, the purpose behind the circuitous route of the continuation 86*c* is to route the original-equipment IPR 34's dump flow around the housing block 60's outflow passage and opening 81 and 82.

FIG. 6 additionally shows that the housing block 60 includes a pump relief flow passage 89 that originates in an opening in the rear sidewall 62, and terminates in an intersection with the enlarged, open-ended rectangular column 73 that accepts the inventive pump-drive gear 56 (the enlarged, open-ended rectangular column 73's cavity is shown better by either of FIG. 4 or 5). The supplementary pump unit 52's mounting flange 83 is formed with a relief exhaust port (not shown). Accordingly, the opening for the housing block 60's pump-relief flow passage 89 is located and arranged to align with the supplementary pump unit 52's pump-relief exhaust port to achieve communication of a relief flow of lube oil therebetween.

It has been discovered that the original-equipment dimension tolerances for crankcase front cover 40's are, while ordinarily quite tight, are relatively loose or lax in at least one significant respect. That is, the chosen elevation for the neck portion 42's top flange surface can be routinely variable, and exceed the apparent tolerances that the majority other dimensions of the front cover are governed by. The consequence is the following. When the inventive housing block 60 is seated upon the top flange surface of one neck portion 42 after another of a random assortment of front covers 40 of the same model series, there in consequence can be an unacceptable amount of variation between the centers of (i) the original-equipment pump-drive gear 36 in any given front cover 40's neck portion 42 and (ii) the at least minor diameter portion 72 of the inventive housing block 60. "Unacceptable" as used here means that, because there can be variation in the distance between the two centers as described, in consequence there might be an unacceptable separation between the two centers the gears 36 and 56 for gear meshing purposes. By way of background, there is a high tolerance set for gear spacing for proper gear meshing.

It is an aspect of the invention to account for this matter by provision of an adjustable feature. More particularly, as FIGS. 5 and 6 show, the major diameter portion 74 of the bore for accepting the cylindrical bearing block 76 of the supplementary pump unit 52 is more accurately formed not in the actual material of the housing block 60 proper but in a press-fitted sleeve 90. The press-fitted sleeve 90 has a cylindrical outer wall. The housing block 60 has a super-sized bore 88 forming a major-diameter halo that has substantially the same inside diameter as the sleeve 90's outside diameter (except a little over-sized for a close-fitting press fit). The super-sized halo-diameter bore 88 in the housing block 60's rear sidewall 62 is aligned on the same central axis as the minor diameter portion 72 that extends through the front sidewall 61. This common central axis is indicated in FIG. 6 by reference numeral 91. The sleeve 90's inner bore 74, while although cylindrical, is eccentric relative the common central axis 91. The eccentric 74's central axis is indicated in FIG. 6 by reference numeral 92. As can be inferred by re-use of the reference numeral 74, the eccentric bore 74 is same the bore which defines what previously above has been referred to as the major diameter portion 74.

Hence FIG. 6 shows that the two central axes 91 and 92 might be spaced about as shown. Rotating the sleeve 90 to different positions on the clock dial causes the eccentric 74's central axis 92 to orbit the stationary common axis 91 of the minor and super-sized halo diameter bores 72 and 88. This can be reckoned in part as follows in FIG. 6. The rear sidewall 62 is inscribed with a reference mark 93 adjacent the super-sized halo diameter 88's periphery, at about the 3 o'clock position. The sleeve 90 has a comparable reference mark 94 inscribed in it, which appears at about the 2 o'clock position. Accordingly, if a vector is imagined, having a tail in the stationary common axis 91 and a head pointing in the direction of the spaced away eccentric axis 92, then this vector would point to the 2 o'clock position. Correspondingly, if the sleeve 90 were twisted so that its reference mark 93 were at the 3 o'clock position, the vector would point to 3 o'clock, and so on, for 6 o'clock, 9 o'clock, 12 o'clock, and all points in between. By this means, sleeve 90 can be twisted such the eccentric 74's axis 92 orbits the stationary common axis 91. It readily follows that the center of pump-drive gear 56 for the supplementary pump unit 52 will align with the eccentric 74's center 92. Accordingly, by twisting the sleeve 90, this can thereby provide adjustability over the spacing between the centers of the two gears 36 and 56, both that of the original-equipment pump unit 32 and that of the inventive supplementary pump unit 52.

FIG. 5 shows the supplementary pump unit 52's mounting flange 83 as secured tightly flush against the housing block 60's rear sidewall 62. Indeed, it is this tight mounting of the supplementary pump unit 52 against the housing block 60 which secures and holds fast the adjusted spacing between the centers of the two gears 36 and 56.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A mounting block for a supplementary lube-oil pump in a diesel-engine fuel injection system that supplements a basic lube-oil pump held mounted by a base structure of the diesel engine, adapted for interposing between matching flange surfaces respectively of the base structure and an overhead reservoir that are capable of being mated together to form a sealed joint without said mounting block interposed therebetween; said mounting block comprising:

spaced endwalls spacing elongated first and second sidewalls between top and bottom flange surfaces that are adapted for mating the flange surfaces of the overhead reservoir and base structure respectively and hence form respective upper and lower sealed joints;

said mounting block being formed with:

a vertical lube-oil supply passage extending between openings in the top and bottom flange surfaces and adapted for providing transit to either an upflow of lube oil originating in the base structure that supplies the reservoir or a downflow from the reservoir;

a wheel-cavity in communication with other openings in the top and bottom flange surfaces and adapted for providing a drive wheel clearance to spin;

a horizontal shaft-cavity originating in an opening in the first sidewall and terminating in the wheel-cavity and adapted for providing a drive shaft of the supplementary pump clearance to extend and attach to the drive wheel in the wheel-cavity therefor; and an outflow passageway originating in the vertical supply passage and terminating in an out-take opening accessible from the first sidewall and adapted for feeding the supplementary pump an intake of lube-oil;

wherein the first sidewall is adapted for providing the supplementary pump a surface to mount thereto and seal the opening in the first sidewall for the shaft-cavity, with the drive shaft extended in the shaft-cavity and the drive wheel in the wheel-cavity attached thereto such that driving the drive wheel from a source in the base structure energizes the supplementary pump for pumping the feed of lube-oil taken from the out-take opening and thereby produce a pumped output; and, wherein the basic pump has a branch line for subtracting a branch flow off the output thereof for regulation purposes, which branch line in part is formed in the base structure and has an outlet formed in the flange surface thereof to mate with an inlet opening therefor in the reservoir's mating flange surface, said mounting block being further formed with a series of internal passageways originating in the bottom flange surface thereof and terminating in the top flange surface thereof to provide a sealed conduit between the base structure and reservoir for the branch flow of lube-oil therebetween.

2. The mounting block of claim 1 further comprising:

at least two through-holes extending between the top and bottom flange surfaces for through-insertion of mounting bolts that cooperatively clamp the mounting block and reservoir to the base structure.

3. The mounting block of claim 1 further comprising:

an apertured shelf formation formed on one of the sidewalls or endwalls thereof along the bottom flange surface and adapted to accept through-extension of a threaded stud projecting up from the base structure as well as allow a nut to be tightened thereon nut against; and, a threaded stud projecting up from the top flange surface thereof as counterpart for the overhead reservoir for the base structure's threaded stud.

4. The mounting block of claim 1 wherein:

the mounting block's series of internal passageways for the basic pump's branch flow are not straight but trace a course which avoids obstacles.

5. The mounting block of claim 1 wherein:

the supplementary pump also has a branch line for subtracting a branch flow off the output thereof and for same purposes of regulation, which branch line for the supplementary pump is formed in part through said mounting block and intersects the series of internal passageways to merge the branch flow of the supplementary pump in common with the branch flow of the basic pump.

6. The mounting block of claim 5 further comprising:

one and another injection pressure regulator (IPR) valves for interposing in the branch lines of the basic and supplementary pump respectively, and having control-signal terminals for servicing an electric control signal from a controller for regulation purposes, wherein the one and another IPR valves control-signal terminals are connected not in parallel but in series for control in unison by said control signal from the controller.

7. The mounting block of claim 1 wherein:

the bottom flange thereof is arranged as a counterpart to the overhead reservoir's mating flange, and the top flange thereof is arranged as a counterpart to the base structure's mating flange.

8. A mounting block for a supplementary lube-oil pump in a diesel-engine fuel injection system that supplements a basic lube-oil pump held mounted by a base structure of the diesel engine, adapted for interposing between matching flange surfaces respectively of the base structure and an overhead reservoir that are capable of being mated together to form a sealed joint without said mounting block interposed therebetween; said mounting block comprising:

spaced endwalls spacing elongated first and second sidewalls between top and bottom flange surfaces that are adapted for mating the flange surfaces of the overhead reservoir and base structure respectively and hence form respective upper and lower sealed joints;

said mounting block being formed with:

a vertical lube-oil supply passage extending between openings in the top and bottom flange surfaces and adapted for providing transit to either an upflow of lube oil originating in the base structure that supplies the reservoir or a downflow from the reservoir;

a wheel-cavity in communication with other openings in the top and bottom flange surfaces and adapted for providing a drive wheel clearance to spin;

a horizontal shaft-cavity originating in an opening in the first sidewall and terminating in the wheel-cavity and adapted for providing a drive shaft of the supplementary pump clearance to extend and attach to the drive wheel in the wheel-cavity therefor; and an outflow passageway originating in the vertical supply passage and terminating in an out-take opening accessible from the first sidewall and adapted for feeding the supplementary pump an intake of lube-oil;

wherein the first sidewall is adapted for providing the supplementary pump a surface to mount thereto and seal the opening in the first sidewall for the shaft-cavity, with the drive shaft extended in the shaft-cavity and the drive wheel in the wheel-cavity attached thereto such that driving the drive wheel from a source in the base structure energizes the supplementary pump for pumping the feed of lube-oil taken from the out-take opening and thereby produce a pumped output; and, wherein the supplementary pump has a cylindrical hub from which the supplementary pump's drive shaft extends; and the mounting block is formed with a bore through the first sidewall and at least into the wheel cavity whereby said bore allows insertion therein of the supplementary pump's cylindrical hub.

9. The mounting block of claim 8 further comprising:

an eccentric collar sized for close-fitting, annular interposition between the supplementary pump's cylindrical hub and the mounting block's bore therefor, wherein dialing the collar through various angular alignments provides adjustability over the position of the supplementary pump's drive wheel relative the source of drive in the base structure.

10. The mounting block of claim 8 wherein:

the supplementary pump's drive shaft and drive wheel therefor are connected by a threaded-fastening system; and the mounting block is formed with an open-ended access passage that extends between the second sidewall and the wheel cavity and is sized for clearance for a socket wrench adapted to twist either a nut or a bolt-head of the threaded-fastening system.

11. The mounting block of claim 10 further comprising:

a plate for securing to the second sidewall and forming a sealed cover across the access opening therein.

12. The mounting block of claim 8 wherein:

wherein the supplementary pump is configured to operate in the counter-rotational direction as the basic pump.

13. A mounting block for a supplementary lube-oil pump in a diesel-engine fuel injection system that supplements a basic lube-oil pump held mounted by a base structure of the diesel engine, adapted for interposing between matching flange surfaces respectively of the base structure and an overhead reservoir that are capable of being mated together to form a sealed joint without said mounting block interposed therebetween; said mounting block comprising:

spaced endwalls spacing elongated first and second sidewalls between top and bottom flange surfaces that are adapted for mating the flange surfaces of the overhead reservoir and base structure respectively and hence form respective upper and lower sealed joints;

said mounting block being formed with:

a vertical lube-oil supply passage extending between openings in the top and bottom flange surfaces and adapted for providing transit to either an upflow of lube oil originating in the base structure that supplies the reservoir or a downflow from the reservoir;

a wheel-cavity in communication with other openings in the top and bottom flange surfaces and adapted for providing a drive wheel clearance to spin;

a horizontal shaft-cavity originating in an opening in the first sidewall and terminating in the wheel-cavity and adapted for providing a drive shaft of the supplementary pump clearance to extend and attach to the drive wheel in the wheel-cavity therefor; and an outflow passageway originating in the vertical supply passage and terminating in an out-take opening accessible from the first sidewall and adapted for feeding the supplementary pump an intake of lube-oil;

wherein the first sidewall is adapted for providing the supplementary pump a surface to mount thereto and seal the opening in the first sidewall for the shaft-cavity, with the drive shaft extended in the shaft-cavity and the drive wheel in the wheel-cavity attached thereto such that driving the drive wheel from a source in the base structure energizes the supplementary pump for pumping the feed of lube-oil taken from the out-take opening and thereby produce a pumped output; and, wherein the wheel cavity opens through the mounting block's top flange surface for a position underneath a drain in the overhead reservoir whereby a current of lube-oil from the overhead reservoir can drain down upon the drive wheel and hence provide lubrication thereto.

* * * * *